US008038806B2

(12) United States Patent
Günther et al.

(10) Patent No.: US 8,038,806 B2
(45) Date of Patent: Oct. 18, 2011

(54) METHOD FOR PRODUCING GRAIN ORIENTED MAGNETIC STEEL STRIP

(75) Inventors: Klaus Günther, Voerde (DE); Ludger Lahn, Moers (DE); Andreas Ploch, Dinslaken (DE); Eberhard Sowka, Dinslaken (DE)

(73) Assignee: ThyssenKrupp Steel AG, Duisburg (DE)

( * ) Notice: Subject to any disclaimer, the term of this patent is extended or adjusted under 35 U.S.C. 154(b) by 287 days.

(21) Appl. No.: 11/997,668

(22) PCT Filed: Jul. 20, 2006

(86) PCT No.: PCT/EP2006/064479

§ 371 (c)(1),
(2), (4) Date: Jun. 30, 2008

(87) PCT Pub. No.: WO2007/014867

PCT Pub. Date: Feb. 8, 2007

(65) Prior Publication Data

US 2009/0139609 A1 Jun. 4, 2009

(30) Foreign Application Priority Data

Aug. 3, 2005 (EP) ..... 05016834

(51) Int. Cl.
*H01F 1/147* (2006.01)

(52) U.S. Cl. ..... 148/111; 148/307; 148/308

(58) Field of Classification Search ..... None
See application file for complete search history.

(56) References Cited

U.S. PATENT DOCUMENTS

| | | | |
|---|---|---|---|
| 4,592,789 A | 6/1986 | Kawamo et al. | |
| 4,919,733 A | 4/1990 | Salsgiver et al. | |
| 5,190,597 A | 3/1993 | Kobayashi et al. | |
| 6,524,400 B1 | 2/2003 | Pircher et al. | |
| 2005/0115643 A1 | 6/2005 | Fortunati | |
| 2008/0216985 A1 * | 9/2008 | Gunther et al. | 164/474 |

FOREIGN PATENT DOCUMENTS

| | | |
|---|---|---|
| DE | 197 45 445 | 7/1999 |
| EP | 0 484 904 | 5/1992 |
| EP | 1 473 371 | 11/2004 |
| JP | 56-158816 | 12/1981 |
| JP | 06 136448 | 12/1995 |
| JP | 2002-212639 | 7/2002 |
| WO | WO 99/19521 | 4/1999 |
| WO | WO 02/50315 | 6/2002 |

OTHER PUBLICATIONS

Patent Abstracts of Japan 06-136448.*
International Search Report for PCT/EP2006/064479.
U.S. Office Action issued in co-pending U.S. Appl. No. 11/997,670 owned by a common Assignee, Mar. 16, 2011.
Amendment and Response to Non-Final Office Action for co-pending U.S. App. No. 11/997,670 dated Jun. 16, 2011, 11 pages.
Final Office Action for co-pending U.S. Appl. No. 11/997,670 dated Jul. 5, 2011, 6 pages.

* cited by examiner

*Primary Examiner* — John Sheehan
(74) *Attorney, Agent, or Firm* — Proskauer Rose LLP

(57) ABSTRACT

A method, which makes it possible to economically produce high-quality grain oriented magnetic steel sheet, utilizes a steel alloy with (in wt %) Si: 2.5-4.0%, C: 0.01-0.10 %, Mn: 0.02-0.50%, S and Se in contents, whose total amounts to 0.005-0.04%. The method utilizes an operational sequence whose individual routine steps (secondary metallurgical treatment of the molten metal in a vacuum-or ladle facility, continuous casting of the molten metal into a strand, dividing of the strand, heating in a facility standing inline, continuous hot rolling in a multi-stand hot rolling mill standing inline, cooling, coiling, cold rolling, recrystallization and decarburization annealing, application of an annealing separator, final annealing to form a Goss texture) are harmonized with one another, so that a magnetic steel sheet with optimized electromagnetic properties is obtained using conventional apparatus.

15 Claims, 1 Drawing Sheet

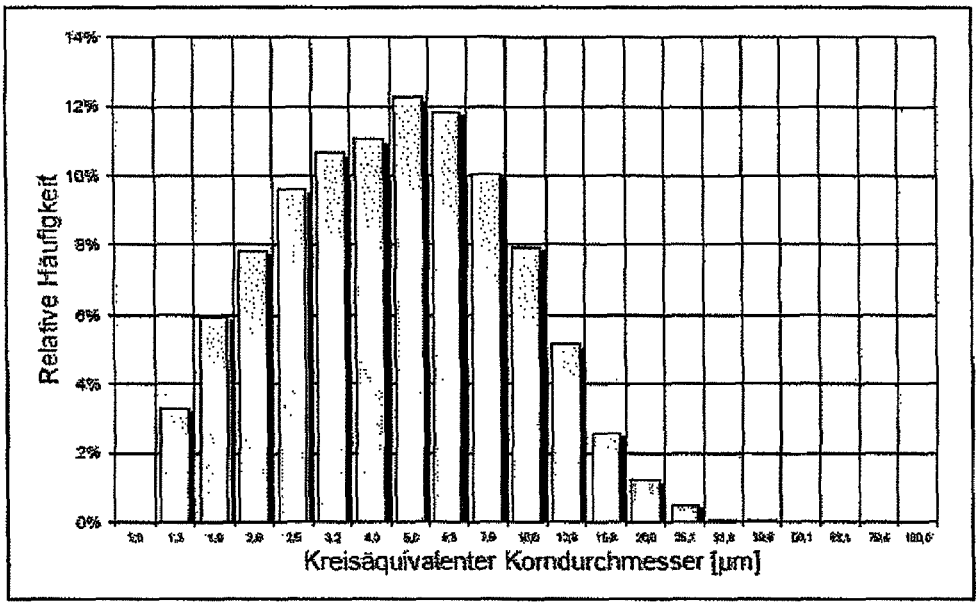
Relative frequency Grain diameter equivalent to a circle [$\mu$m]
Fig. 1: Grain size distribution of the hot rolling variant " WWI " after the 2nd pass
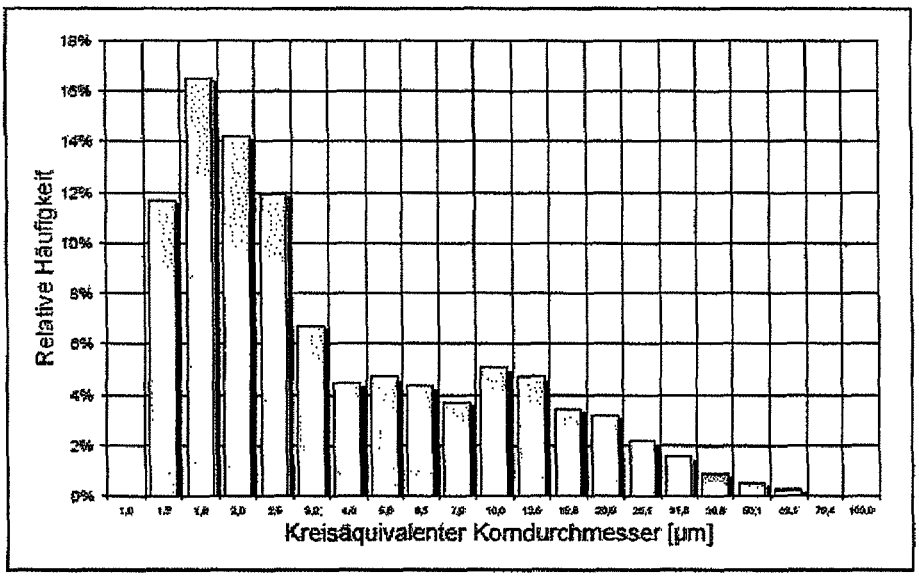
Relative frequency Grain diameter equivalent to a circle [$\mu$m]
Fig. 2: Grain size distribution of the hot rolling variant " WW2 " after the 2nd pass

METHOD FOR PRODUCING GRAIN ORIENTED MAGNETIC STEEL STRIP

CROSS-REFERENCE TO RELATED APPLICATIONS

This application is a National Phase Application of International Application No. PCT/EP2006/064479, filed on Jul. 20, 2006, which claims the benefit of and priority to European patent application no. EP 05 016 834.3, filed Aug. 3, 2005, which is owned by the assignee of the instant application. The disclosure of each of the above applications is incorporated herein by reference in their entirety.

FIELD OF THE INVENTION

The invention relates to a method for producing high-quality grain oriented magnetic steel strip, so-called CGO material (conventional grain oriented material) using the thin slab continuous casting process.

BACKGROUND

In principle it is known that thin slab continuous casting mills are especially suitable for producing magnetic steel sheet due to the advantageous control of temperature made possible by inline processing of thin slabs. Thus JP 2002212639 A describes a method for producing grain oriented magnetic steel sheet, wherein a molten metal, which (in wt %) contains 2.5-4.0% Si and 0.02-0.20% Mn as the main inhibitor components, 0.0010-0.0050% C, 0.002-0.010% Al plus amounts of S and Se as well as further optional alloying components, such as Cu, Sn, Sb, P, Cr Ni, Mo and Cd, the remainder being iron and unavoidable impurities, is formed into thin steel slabs having a thickness of 30-140 mm. In one embodiment of this prior art method, the thin slabs are annealed at a temperature of 1000-1250° C. before hot rolling, in order to obtain optimum magnetic properties in the finished magnetic steel sheet. Furthermore the prior art method requires that the hot strip, which is 1.0-4.5 mm thick after hot rolling, is annealed for 30-600 seconds at temperatures of 950-1150° C., before it is rolled with deformation strains of 50-85% into cold strip. As advantage for using thin slabs as pre-material for producing magnetic steel sheet, it is pointed out in JP 2002212639 A that an even temperature distribution and an equally homogeneous microstructure can be guaranteed over the entire slab cross section due to the small thickness of the thin slabs, so that the strip obtained possesses a correspondingly even characteristic distribution over its thickness.

Another method for producing grain oriented magnetic steel sheet, which however only concerns the production of standard qualities, so-called CGO material (conventional grain oriented material), is known from JP 56-158816 A. In this method a molten metal, containing (in wt %) 0.02-0.15% Mn as the main inhibitor component, more than 0.08% C, more than 4.5% Si, and in total 0.005-0.1% S and Se, the remainder being iron and unavoidable impurities, is cast into thin slabs having a thickness of 3-80 mm. Hot rolling of these thin slabs begins before their temperature drops below 700° C. In the course of hot rolling the thin slabs are rolled into hot strip having a thickness of 1.5-3.5 mm. The thickness of the hot strip in this case has the disadvantage that the standard final thickness of below 0.35 mm, which is the commercial norm for grain oriented magnetic steel sheet, can only be produced with a cold rolling deformation strain above 76% in a single-stage cold rolling process or by conventional multi-stage cold rolling with intermediate annealing, whereby it is disadvantageous with this method that the high cold deformation strain is not adapted to the relatively weak inhibition by MnS and MnSe. This leads to non-stable and unsatisfactory magnetic properties of the finished product. Alternatively a more elaborate and more expensive multi-stage cold rolling process with intermediate annealing must be accepted.

Further possibilities of producing grain oriented magnetic steel sheet using a thin slab continuous casting mill are extensively documented in DE 197 45 445 C1. In the method developed from DE 197 45 445 C1 and against the background of the prior art known at this time, a silicon steel melt is produced, which is continuously cast into a strand having a thickness of 25-100 mm. The strand is cooled during the solidification process to a temperature higher than 700° C. and divided into thin slabs. The thin slabs are then fed to an equalizing facility standing inline and heated there to a temperature <=1170° C. The thin slabs, heated in such a manner, are subsequently rolled continuously in a multi-stand hot rolling mill to form hot strip having a thickness of <=3.0 mm, the first forming run being carried out when the rolled strip internal temperature is 1150° C. maximum with the reduction in thickness being at least 20%.

In order to be able to utilize the advantages of the casting/rolling process, as a result of using thin slabs as pre-material, for producing grain oriented magnetic steel sheet, the hot rolling parameters in accordance with the explanations given in DE 197 45 445 C1 must be selected in such a way that the metal always remains sufficiently ductile. In this connection it is stated in DE 197 45 445 C1 that with respect to the pre-material for grain oriented magnetic steel sheet, ductility is greatest if the strand is cooled after solidification to approx. 800° C., then held only relatively briefly at equalizing temperature, for example 1150° C., and is thereby heated homogeneously throughout. Optimum hot rolling ability of such a material is the case therefore if the first forming run takes place at temperatures below 1150° C. with a deformation strain of at least 20% and the strip, starting from an intermediate thickness of 40-8 mm, is brought by means of high pressure inter-stand cooling devices, in two sequential forming runs at most, to rolling temperatures of less than 1000° C. Thus it is avoided that the strip is formed in the temperature range of around 1000° C., which is critical with respect to ductility.

In accordance with DE 197 45 445 C1 the hot strip formed in this way is then cold rolled in one or several stages with intermediate recrystallization annealing to a final thickness ranging between 0.15 and 0.50 mm. The cold strip is finally subjected to recrystallization and decarburization annealing, provided with a predominantly MgO containing annealing separator, then subjected to final annealing in order to form a Goss texture. Finally the strip is coated with an electric insulation and subjected to annealing for relieving stresses.

Despite the extensive proposals for practical use, documented in the prior art, the use of casting mills, wherein typically a strand having a thickness of usually 40-100 mm is cast and then divided into thin slabs, for producing grain oriented magnetic steel sheet remains the exception due to the special requirements, which arise in the production of magnetic steel sheet with respect to molten metal composition and processing control.

Practical investigations demonstrate that pivotal importance is attached to the ladle furnace as regards the use of thin slab continuous casting mills. In this unit the molten steel is fed to the thin slab continuous casting mill and adjusted by heating to the desired temperature for casting. In addition the chemical composition of the steel concerned can be finally adjusted in the ladle furnace by adding alloying elements. Furthermore the slag in the ladle furnace is usually conditioned. When processing steel calmed with aluminium, small amounts of Ca are added to the molten steel in the ladle furnace, in order to guarantee the castability of this steel.

Although in the case of steel calmed with silicon-aluminium, needed for grain oriented magnetic steel sheet, no addition of Ca is required to guarantee castability, the oxygen activity in the ladle slag must be reduced.

The production of grain oriented magnetic steel sheet additionally requires very precise adjustment of the target chemical analysis, that is to say the contents of the individual components must be adjusted very exactly in harmony with one another, so that depending on the absolute content selected, the limits of some components are very tight. Here treatment in the ladle furnace reaches its limits.

Substantially better conditions can be achieved in this respect by using a vacuum facility. In contrast to ladle degassing however an RH or DH vacuum facility is not suitable for slag conditioning. This is necessary in order to guarantee the castability of melts used for producing grain oriented magnetic steel sheet.

SUMMARY OF THE INVENTION

In general, in one aspect, the invention is directed to a method, which makes it possible to economically produce high-quality grain oriented magnetic steel sheet using thin slab continuous casting mills.

This aspect is achieved by a method for producing grain oriented magnetic steel strip, which according to the invention comprises the following routine steps:

a) Melting of a steel, which beside iron and unavoidable impurities contains (in wt %) Si: 2.5-4.0%,
C: 0.01-0.10%,
Mn: 0.02-0.50%,
S and Se with contents whose total amounts to 0.005-0.04%,
and optionally:
up to 0.07% Al,
up to 0.015% N,
up to 0.035% Ti,
up to 0.3% P,
one or more elements from the group of As, Sn, Sb, Te, Bi with contents up to 0.2% in each case,
one or more elements from the group of Cu, Ni, Cr, Co, Mo with contents up to 0.3% in each case,
one or more elements from the group of B, V, Nb with contents up to 0.012% in each case,
b) secondary metallurgical treatment of the molten metal in a ladle furnace and/or a vacuum facility,
c) continuous casting of the molten metal into a strand,
dividing of the strata into thin slabs,
e) heating of the thin slabs in a facility standing inline to a temperature ranging between 1050 and 1300° C.,
the dwell time in the facility being 60 minutes maximum,
f) continuous hot rolling of the thin slabs in a multi-stand hot rolling mill standing inline into hot strip having a thickness of 0.5-4.0 mm,
during this hot rolling stage the first forming run being carried out at a temperature of 900-1200° C. with a deformation strain of more than 40%,
the reduction per pass in the second forming run being more than 30% and
the reduction per pass in the final hot rolling run being 30% maximum,
g) cooling of the hot strip,
h) reeling of the hot strip into a coil,
i) optionally: annealing of the hot strip after coiling or before cold rolling,
j) cold rolling of the hot strip into cold strip having a final thickness of 0.15-0.50 mm, this cold rolling being able to take place either in one stage or also in several stages with intermediate recrystallization annealing,
k) recrystallization and decarburization annealing of the cold strip, optionally also with nitrogenization during or after decarburization,
l) final annealing of the recrystallization and decarburization annealed cold strip in order to form a Goss texture,
m) optionally: coating of the finish annealed cold strip with an electric insulation and subsequent annealing of the coated cold strip for relieving stresses.

BRIEF DESCRIPTION OF THE FIGURES

FIG. 1 is a graph illustrating grain size distribution of a hot rolled variant WW1, a variant in accordance with an embodiment of the invention, after a second pass, FIG. 2 is a graph showing grain size distribution of a hot rolled variant WW2, a prior art variant, after a second pass.

DESCRIPTION

The working sequence proposed by the invention is harmonized in such a way that magnetic steel sheet, which possesses optimized electromagnetic properties, can be produced using conventional apparatus.

To this end steel of presently known composition is melted in the first step. This molten steel is then subject to secondary metallurgical treatment. This treatment initially takes place preferably in a vacuum facility to adjust the chemical composition of the steel within the required narrow range of analysis and to achieve a low hydrogen content of 10 ppm maximum, in order to lessen the danger of the strand breaking to a minimum when the molten steel is cast.

Following treatment in the vacuum facility it is expedient to continue the process with a ladle furnace, in order in the event of casting delays to be able to guarantee the temperature necessary for casting and to condition the slag to avoid in the course of thin slab continuous casting clogging up of the immersion nozzles in the shell, and thus avoid having to abort the casting process.

According to the invention initially a ladle furnace would be used for slag conditioning, followed by treatment in a vacuum facility in order to adjust the chemical composition of the molten steel within narrow limits of analysis. This combination however is linked with the disadvantage that in the event of casting delays the temperature of the molten metal drops to such an extent that it is no longer possible to cast the molten steel.

It is also consistent with the invention to use only the ladle furnace. However this is linked with the disadvantage that the analysis is not as precise as in the case of treatment in a vacuum facility and moreover a high hydrogen content may develop when the molten metal is cast with the danger of the strand breaking.

It is also consistent with the invention to use only the vacuum facility. However on the one hand this carries the danger that in the event of casting delays the temperature of the molten metal drops to such an extent that it is no longer possible to cast the molten steel, on the other hand the danger exists that the immersion nozzles become clogged up during the process and thus casting must be aborted.

In accordance with the invention therefore if a ladle furnace and vacuum facility are available and depending on the particular steel metallurgy and casting requirements both mills are used in combination.

A strand, preferably having a thickness of 25-150 mm, is then cast from the molten metal treated in this way.

When the strand is cast in the narrow shell of thin slab continuous casting mills, high flow rates, turbulence and uneven flow distribution over the strand width arise in the liquid level zone. This leads on the one hand to the solidification process becoming uneven, so that longitudinal surface cracks can occur in the cast strand. On the other hand as a result of the molten metal flowing unevenly, casting slag or flux powder is flushed into the strand. These inclusions degrade the surface finish and the internal purity of the thin slabs divided from the cast strand after it has solidified.

In one advantageous embodiment of the invention, such defects can be avoided to a large extent as a result of the molten steel being poured into a continuous moulding shell, which is equipped with an electromagnetic brake. When used in accordance with the invention, such a brake results in calming and evening out of the flow in the shell, particularly in the liquid level zone by producing a magnetic field, which by reciprocally reacting with the molten metal jets entering the shell reduces their speed through the so-called "Lorentz force" effect.

The emergence of a microstructure in the cast steel strand, which is favourable with respect to the electromagnetic properties, can also be enhanced if casting is carried out at low overheating temperature. The latter is preferably 25 K maximum above the liquidus temperature of the cast molten metal. If this advantageous variant of the invention is considered, freezing up in the liquid level zone of the molten steel cast at low overheating temperature, and thus casting problems up to the point of having to abort the process, can be avoided by using an electromagnetic brake on the moulding shell. The force exerted by the electromagnetic brake brings the hot molten metal to the liquid level zone and causes a rise in temperature there, which is sufficient to ensure trouble-free casting.

The homogeneous and fine-grained solidification microstructure of the cast strand obtained in this way advantageously influences the magnetic properties of grain oriented magnetic steel sheet produced according to the invention.

It is proposed in one advantageous embodiment of the invention to carry out inline thickness reduction of the strand, which has been cast from the molten metal but which is still liquid at the core.

As methods for reducing the thickness known per se, so-called liquid core reduction in the following "LCR"—and so-called soft reduction—in the following "SR"—can be employed. These possibilities of reducing the thickness of a cast strand can be used on their own or in combination.

In the case of LCR the strand thickness is reduced close below the shell, while the core of the strand is still liquid. LCR is used according to the prior art in thin slab continuous casting mills primarily in order to achieve a smaller hot strip final thickness, particularly in the case of high-strength steel. In addition through LCR the thickness reductions or the rolling forces in the rolling stands of the hot strip mill can be successfully decreased, so that routine wear of the rolling stands and the scale porosity of the hot strip can be minimized and the strip run improved. The thickness reduction obtained by LCR according to the invention preferably lies between 5 and 30 mm.

SR is understood to mean controlled thickness reduction of the strip at the lowest point of the liquid pool shortly before final solidification. The aim of SR is to reduce centre segregations and core porosity. This method has predominantly been used up till now in cogged ingot and thin slab continuous casting mills, The invention now proposes the use of SR also for producing grain oriented magnetic steel sheet on thin slab continuous casting mills or casting/rolling mills. By the reduction, achievable in this way, particularly of silicon centre segregation in the subsequently hot rolled pre-products, it is possible to homogenize the chemical composition over the strip thickness, which is advantageous with respect to the magnetic properties. Good SR results are achieved if the thickness reduction through the use of SR is 0.5-5 mm. The following can serve as a reference for the moment in time when SR is used in connection with continuous casting performed according to the invention:

start of the SR zone with a degree of solidification $f_S$=0.2,
end of the SR zone where $f_S$=0.7-0.8

In the case of thin slab continuous casting mills, the strand normally leaving the moulding shell vertically is bended at deep-lying places into the horizontal direction. In a further advantageous embodiment of the invention as a result of the strand cast from the molten metal being bended into the horizontal direction and straightened at a temperature ranging between 700 and 1000° C. (preferably 850-950° C.), cracks on the surface of the thin slabs separated from the strand, which would otherwise occur particularly as a consequence of cracks at the edges of the strand, can be avoided. In the temperature range mentioned, the steel used according to the invention possesses good ductility on the strand surface or near the edges, so that it can safely follow the deformations arising when being bended and straightened into the horizontal direction.

In the presently known way thin slabs, which are subsequently heated in a facility to the start temperature suitable for hot rolling and then taken to the hot rolling stage, are divided from the cast strand. The temperature, at which the thin slabs enter the facility, is preferably above 650° C. The dwell time in the facility should be less than 60 minutes in order to avoid scale.

In accordance with the invention the first hot rolling pass is carried out at 900-1200° C. in order to be able to achieve the deformation strain of >40% with this pass. In the first hot rolling pass according to the invention a deformation strain of at least 40% is reached, so as to achieve only a comparatively small reduction per pass in the final rolling stands necessary to obtain the desired final strip thickness. The use of high reductions per pass (deformation strains) in the first two rolling stands results in the necessary reduction of the coarse-grained solidification microstructure to a fine rolled microstructure, which is the pre-condition for good magnetic properties of the final product being fabricated. Accordingly the reduction per pass at the final rolling stand should be limited to 30% maximum, preferably less than 20%, whereby it is also advantageous for a desired hot rolling result, which is optimum with respect to the properties strived for, if the reduction per pass in the penultimate rolling stand of the finishing train is less than 25%. A reduction pass schedule established in practice on a seven stand hot strip rolling mill, which has resulted in optimum properties of the finished magnetic steel sheet, prescribes that for a pre-strip thickness of 63 mm and a hot strip final thickness of 2 mm, the strain obtained at the first stand is 62%, at the second stand 54%, at the third stand 47%, at the fourth stand 35%, at the fifth stand 28%, at the sixth stand 17% and at the seventh stand 11%.

In order to avoid a rough uneven microstructure or rough precipitations on the hot strip, which would impair the magnetic properties of the final product, it is advantageous to start to cool the hot strip as soon as possible after the final rolling stand of the finishing train. In one practical embodiment of the invention it is therefore proposed to begin cooling with water within five seconds maximum after leaving the final rolling stand. In this case the aim is for short as possible pause periods, of one second or less for example.

The cooling of the hot strip can be also be performed in a way that cooling with water is carried out in two stages. To this end following the final rolling stand the hot strip can firstly be cooled down to close below the alpha/gamma reduction temperature, in order then, preferably after a cooling pause of one to five seconds so as to equalize the temperature over the strip thickness, to carry out further cooling with water down to the necessary coiling temperature. The first phase of cooling can take place in the form of so-called "compact cooling", wherein the hot strip is rapidly cooled down over a short distance at high intensity and cooling rate (at least 200 K/s) by dispensing large quantities of water, while the second phase of water cooling takes place over a longer distance at less intensity so that an even as possible cooling result over the strip cross section is achieved.

The coiling temperature should lie preferably in the temperature range of 500-780° C. Higher temperatures on the one hand would lead to undesirable rough precipitations and on the other hand would reduce pickling ability. In order to use higher coiling temperatures (>700° C.) a so-called short distance coiler is employed, which is arranged immediately after the compact cooling zone.

For further optimization of the microstructure the hot strip obtained in this way can be optionally annealed again after coiling or before cold rolling.

If the hot strip is cold rolled in several stages, it may be expedient to optionally carry out intermediate annealing between the cold rolling stages.

After cold rolling the strip obtained is subjected to recrystallization and decarburization annealing. In order to form the nitride precipitations, which are used to control grain growth, the cold strip can be subjected to nitrogenization annealing during or after decarburization annealing in an atmosphere containing $NH_3$.

A further possibility of forming the nitride precipitations is to apply N-containing anti-stick compounds, such as for example manganese nitride or chrome nitride, onto the cold strip following decarburization annealing with the nitrogen being diffused into the strip during the heating phase of final annealing before secondary recrystallization.

The invention is described below in detail on the basis of one exemplary embodiment.

EXAMPLE 1

A molten steel with the composition of 3.22% Si, 0.020% C, 0.066% Mn, 0.016% S, 0.013% Al, 0.0037% N, 0.022% Cu and 0.024% Cr, after secondary metallurgical treatment, was continuously cast in a ladle furnace and a vacuum facility to 63 mm thick strand. Before entering the equalizing facility standing inline the strand was divided into thin slabs. After a dwell time of 20 minutes in the equalizing facility at 1150° C., the thin slabs were then de-scaled and hot rolled in different ways:

Variant "WW1": In the case of this variant according to the invention the first pass took place at 1090° C. with a deformation strain $\epsilon_1$ of 61% and the second pass at 1050° C. with a deformation strain $\epsilon_2$ of 50%. In the case of the final two passes the reduction strains were $\epsilon_6$=17% and $\epsilon_7$=11%.

Variant "WW2". This variant not according to the invention was differentiated by a thickness reduction of 28% in the first pass and 28% in the second pass, whereby the final two passes had a deformation strain of 28% and 20%.

Cooling was identical for both hot roll variants by spraying with water within 7 seconds after leaving the final rolling stand to a coiling temperature of 610° C. As well as the hot strip produced in this way having a thickness of 2.0 mm, samples for micrographic investigations were also obtained by aborting hot rolling after the 2nd pass by means of rapid cooling. In the subsequent magnetic strip processing, the strip was first annealed in the continuous facility and then cold rolled in a single stage without intermediate annealing to 0.30 mm final thickness. For the anneals following on 2 different variants were again selected:

Variant "E1": Only standard decarburization annealing at 860° C. took place, wherein the strip was recrystallized and decarburized, Variant "E2": Here the strip was nitrogenized following standard inline decarburization annealing for 30 seconds at 860° C. in an $NH_3$ containing atmosphere. Afterwards all the strip was finally annealed to form a sharp Goss texture, coated with an electric insulation and subjected to annealing for relieving stresses.

The following table represents the magnetic results of the individual strip as a function of its different processing conditions ($\epsilon$1/$\epsilon$2/$\epsilon$6/$\epsilon$7: deformation strains in the corresponding hot rolling passes):

| Hot rolling conditions | | | | | | Magnetic result | | |
|---|---|---|---|---|---|---|---|---|
| Variant | $\epsilon$1 [%] | $\epsilon$2 [%] | $\epsilon$6 [%] | $\epsilon$7 [%] | Decarburization variant | $J_{800}$ [T] | $P_{1,7}$ [W/kg] | Comment |
| WW1 | 61 | 50 | 17 | 11 | E1 (no nitrogenizing) | 1.82 | 1.26 | According to invention |
| WW1 | 61 | 50 | 17 | 11 | E2 (with nitrogenizing) | 1.88 | 1.18 | |
| WW2 | 28 | 28 | 28 | 20 | E1(no nitrogenizing) | 1.70 | 1.85 | Not according to invention |
| WW2 | 28 | 28 | 28 | 20 | E2 (with nitrogenizing) | 1.74 | 1.70 | |

The different magnetic results as a function of the hot rolling conditions selected can be explained on the basis of the different microstructures. In the case of the variant according to the invention "WW1" a finer and above all substantially homogeneous microstructure (FIG. 1) is formed by the high deformation strains in the first two rolling passes. After the 2nd pass an average grain size of 5.07 μm with a standard deviation of 3.65 μm is the case here.

By contrast hot rolling under conditions not according to the invention (variant "WW2") after the 2nd pass leads to a substantially less homogeneous microstructure (FIG. 2) having an average grain size of 5.57 μm with a standard deviation of 7.43 μm.

The invention claimed is:

1. Method for producing grain oriented magnetic steel strip using a continuous casting process for thin slabs, comprising the following steps:

a) Melting of a steel, which beside iron and unavoidable impurities contains (in wt %)
   Si: 2.5-4.0%,
   C: 0.01-0.10%,
   Mn: 0.02-0.50%
   S and Se with contents whose total amounts to 0.005-0.04%,
   and optionally:
      up to 0.07% Al,
      up to 0.015% N,
      up to 0.035% Ti,
      up to 0.3% P,
      one or more elements from the group of As, Sn, Sb, Te, Bi each with a content of up to 0.2%,
      one or more elements from the group of Cu, Ni, Cr, Co, Mo each with a content of up to 0.3%,
      one or more elements from the group of B, V, Nb each with a content of up to 0.012%,
b) secondary metallurgical treatment of the molten metal in a vacuum facility and in a ladle furnace,
c) continuous casting of the molten metal into a strand,
d) dividing of the strand into thin slabs,
e) heating of the thin slabs in a heating facility standing in a line to a temperature ranging between 1050 and 1300° C., the dwell time in the facility being 60 minutes maximum,
f) continuous hot rolling of the thin slabs in a multi-stand hot rolling mill standing in a line into a hot strip having a thickness of 0.5-4.0 mm,
   during this hot rolling stage a first forming run being carried out at a temperature of 900-1200° C. with a deformation strain of more than 40%,
   the reduction per pass in a second forming run being more than 30% and
   the reduction per pass in a final hot rolling run being 30% maximum,
g) cooling of the hot strip,
h) reeling of the hot strip into a coil,
i) cold rolling of the hot strip into cold strip having a final thickness of 0.15-0.50 mm,
j) recrystallization and decarburization annealing of the cold strip,
k) application of an annealing separator onto the cold strip surface, and
n) final annealing of the recrystallization and decarburization annealed cold strip in order to form a Goss texture.

2. Method according to claim 1, wherein the molten steel in the course of the secondary metallurgical treatment (step b) is initially treated in the vacuum facility and then in the ladle furnace.

3. Method according to claim 1, wherein the molten metal in the course of the secondary metallurgical treatment (step b) is treated alternatingly in the ladle furnace and in the vacuum facility.

4. Method according to claim 1, wherein the secondary metallurgical treatment (step b) of the molten metal is continued for such a time until its hydrogen content is 10 ppm maximum during the casting process (step c).

5. Method according to claim 1, wherein the molten steel is cast into the strand (step d) in a continuous moulding shell, which is equipped with an electromagnetic brake.

6. Method according to claim 1, wherein inline thickness reduction of the strand, cast from the molten metal but still liquid at the core, takes place in the course of step c).

7. Method according to claim 1, wherein the strand cast from the molten metal is bent into a horizontal direction and straightened in the course of step c) at a temperature of between 700 and 1000° C.

8. Method according to claim 1, wherein the strand enters the heating facility standing in a line at a temperature above 650° C.

9. Method according to claim 1, wherein cooling of the hot strip begins at the latest five seconds after leaving the final rolling stand.

10. Method according to claim 1, wherein the cold strip is nitrogenized during or after decarburization by annealing in an ammonia-containing atmosphere.

11. Method according to claim 1, wherein one or several chemical compounds are added to the annealing separator, which results in nitrogenization of the cold strip during the heat-up phase of final annealing before secondary recrystallization.

12. Method according to claim 1 further comprising annealing of the hot strip after coiling or before cold rolling.

13. Method according to claim 1 further comprising coating of the annealed cold strip having a Goss texture with an electric insulation and subsequent annealing of the coated cold strip for relieving stresses.

14. Method according to claim 13 further comprising domain refinement of the coated cold strip.

15. Method according to claim 1, wherein the molten steel in the course of its secondary metallurgical treatment (step b) is initially treated in the ladle furnace and then in the vacuum facility.

* * * * *